US006853834B2

(12) United States Patent
Kurimoto et al.

(10) Patent No.: US 6,853,834 B2
(45) Date of Patent: Feb. 8, 2005

(54) IMAGE FORMING APPARATUS AND COPIER

(75) Inventors: Eiji Kurimoto, Numazu (JP); Ryohichi Kitajima, Numazu (JP); Yoshiaki Kawasaki, Susono (JP); Akihiro Sugino, Numazu (JP); Takaaki Ikegami, Susono (JP)

(73) Assignee: Ricoh Company Limited, Tokyo (JP)

( * ) Notice: Subject to any disclaimer, the term of this patent is extended or adjusted under 35 U.S.C. 154(b) by 22 days.

(21) Appl. No.: 10/628,532

(22) Filed: Jul. 29, 2003

(65) Prior Publication Data

US 2004/0028435 A1 Feb. 12, 2004

(30) Foreign Application Priority Data

Jul. 29, 2002 (JP) ..... 2002-219695
Jul. 15, 2003 (JP) ..... 2003-197304

(51) Int. Cl.[7] ..... G03G 21/00
(52) U.S. Cl. ..... 399/353
(58) Field of Search ..... 399/343, 344, 399/346, 347, 353

(56) References Cited

U.S. PATENT DOCUMENTS

| | | | | |
|---|---|---|---|---|
| 5,339,138 | A | 8/1994 | Mishima et al. | |
| 5,578,405 | A | 11/1996 | Ikegami et al. | |
| 5,702,855 | A | 12/1997 | Ikegami et al. | |
| 6,030,736 | A | 2/2000 | Ikegami et al. | |
| 6,319,878 | B1 | 11/2001 | Ina et al. | |
| 6,415,129 | B2 * | 7/2002 | Sawayama | 399/353 |
| 6,432,596 | B2 | 8/2002 | Ikuno et al. | |
| 6,521,387 | B2 | 2/2003 | Kawasaki | |
| 6,558,863 | B2 | 5/2003 | Rokutanzono et al. | |
| 6,573,016 | B2 | 6/2003 | Kami et al. | |
| 6,618,565 | B2 | 9/2003 | Tamiya et al. | |
| 2002/0076633 | A1 | 6/2002 | Niimi | |

FOREIGN PATENT DOCUMENTS

| | | |
|---|---|---|
| JP | 1-116677 | 5/1989 |
| JP | 1-205171 | 8/1989 |
| JP | 3-78782 | 4/1991 |
| JP | 6-289759 | * 10/1994 |
| JP | 7-333881 | 12/1995 |
| JP | 8-15887 | 1/1996 |
| JP | 8-101524 | 4/1996 |
| JP | 8-123053 | 5/1996 |
| JP | 8-146641 | 6/1996 |
| JP | 8-314175 | 11/1996 |
| JP | 9-50215 | * 2/1997 |
| JP | 9-288441 | 11/1997 |
| JP | 2001-51549 | * 2/2001 |

* cited by examiner

*Primary Examiner*—Hoan Tran
(74) *Attorney, Agent, or Firm*—Oblon, Spivak, McClelland, Maier & Neustadt, P.C.

(57) ABSTRACT

An image forming apparatus including a photoreceptor having an electroconductive substrate, a photosensitive layer overlying the electroconductive substrate, and a protection layer including an inorganic filler in an amount of from 3 to 25% by weight based on total weight of the protection layer and a binder resin, and overlying the photosensitive layer. The apparatus further including a charger, an irradiator, an image developer, and a transferer transferring a toner image onto a transfer material. The apparatus also includes a cleaner cleaning the photoreceptor, including a rotatable core and a looped brush fiber provided on the surface of the rotatable core so as to contact the photoreceptor. A top of the looped brush fiber is positioned on an upstream side from a root of the looped brush fiber relative to a rotating direction of the rotatable core.

9 Claims, 7 Drawing Sheets

IMAGE FORMING APPARATUS AND COPIER

BACKGROUND OF THE INVENTION

1. Field of the Invention

The present invention relates to an image forming apparatus and a copier.

2. Discussion of the Background

An electrophotographic process is typically one of image forming methods of charging a photoconductive photoreceptor in a dark place with, e.g., a corona discharge; irradiating the photoreceptor with imagewise light; forming an electrostatic latent image thereon by selectively scattering a charge on the irradiated part thereon; and developing the latent image with a toner including a colorant such as dyes and pigments and a binder such as polymers to form a visual toner image.

Image forming apparatuses using the electrophotographic process include an electrophotographicprinter, etc. Recently, the image forming apparatuses are required to have high durability in addition to producing high-quality images.

A photoreceptor in the electrophotographic process repeatedly receiving mechanical and chemical influences in repeated charging, irradiating, developing, transferring and cleaning processes gradually deteriorates and wears. A worn photoreceptor causes deterioration of its chargeability and abnormal images. Therefore, longevity of the image forming apparatus using the electrophotographic process depends on longevity of the photoreceptor in many cases, and it is quite essential that a photoreceptor having good abrasion resistance is used for the image forming apparatus to have high durability.

For example, Japanese Laid-Open Patent Publications Nos. 1-205171, 7-333881, 8-15887, 8-123053 and 8-146641 describe technologies to improve abrasion resistance of a photoreceptor by forming a protection layer on the surface thereof and including an inorganic filler in a photosensitive layer thereof.

However, photoreceptors using the technologies described in Japanese Laid-Open Patent Publications Nos. 1-205171, 7-333881, 8-15887, 8-123053 and 8-146641 have good abrasion resistance, but light portion potentials thereof increase in long-term continuous repeated use and the photoreceptors have drawbacks of image quality deterioration such as image density deterioration. The protection layer on the surface of a photoreceptor can improve mechanical abrasion resistance thereof. However, when a foreign particle is adhered to a surface of a photoreceptor for some reason, the surface thereof tends to have a scratch causing an image defect. Therefore, it is difficult to make full use of a photoreceptor including a protection layer on the surface thereof in an electrophotographic process in some regards.

The foreign particle adhered to a surface of a photoreceptor includes a toner which is not cleaned. A toner adhered on a photoreceptor, which is not cleaned causes defective images. Therefore, even a highly-durable photoreceptor is considered to come to an end of its life, i.e., an image forming apparatus including the photoreceptor is considered to come to an end of its life, when producing a defective image.

Conventionally, a toner having a small particle diameter is used to realize high quality images. Although the toner having a small particle diameter can dramatically improve image quality, it is difficult to clean the toner having a small particle diameter. Therefore, the toner which is not cleaned tends to adhere on a photoreceptor and the problem mentioned above tends to occur.

In accordance with higher durability of photoreceptors, the problem mentioned above occurs due to not only the toner which is not cleaned but also paper powders, toner additives and other foreign particles because opportunities in which a paper powder caused by a paper used accumulates on photoreceptors, additives in a toner agglutinate thereon and other foreign particles adhere thereon increase.

In order to cope with the problem, removal of untransferred toner and foreign particles such as paper powders is prioritized, and e.g., it can be considered that a cut-pile shaped cleaning brush having a thicker or firmer base thread than a conventional thread is used to improve toner removal capability and cleanability.

However, when the cleanability is strengthened more than necessary, a photoreceptor is abnormally abraded or a surface roughness thereof becomes large. Therefore, the photoreceptor cannot sufficiently be cleaned earlier, which causes image defects in many cases. For example, as mentioned above, when the cut-pile shaped cleaning brush having a thicker or firmer base thread is used, a point contact of a cross sectional edge of the thread with a photoreceptor scratches a surface thereof and causes an abnormal abrasion thereof, resulting in image defects.

Particularly, as mentioned above, when the cleanability is strengthened more than necessary in an image forming apparatus including a photoreceptor including a protection layer on its surface including an inorganic filler, the filler is easily released from the protection layer and the released filler tends to scratch a surface of the photoreceptor. Such a scratch on the protection layer in which an inorganic filler is dispersed is considered to be caused by an abrasion of the inorganic filler, which is released from the surface layer as the abrasion thereof proceeds due to long-term repeated use, with the photoreceptor when cleaned. A photoreceptor has innumerable scratches when cleaned unless cleaning conditions are adjusted because the inorganic filler typically has quite a high hardness. A toner which adheres to the scratches and cannot be removed causes defective stripe or micro-spot images.

Recently, such defective images tend to be produced more when a toner having a small particle diameter, particularly a spheric toner such as a polymerized toner, is used to produce higher quality images. It is difficult to produce high quality images without producing abnormal images and have high durability to keep producing high quality images for a long time.

Such problems also occur even in an image forming apparatus described in Japanese Laid-Open Patent Publication No. 8-314175, wherein a photoreceptor includes inorganic fine particles in its surface layer to decrease abrasion of the surface and a rubber blade and a brush are contacted with the photoreceptor to sufficiently clean the photoreceptor.

As mentioned above, a highly durable photoreceptor which is essential for forming images and, at the same time, a cleaning unit which fully takes advantage of the durability are indispensable for an image forming apparatus producing high quality images and having high durability.

However, such an image forming apparatus producing high quality images and having high durability is not available.

Japanese Patents Nos. 2619424 and 2793647 describe a brush cleaner having a loop-shaped portion which contacts a surface of a photoreceptor to improve cleanability and decrease damages of the photoreceptor due to cleaning. However, higher quality images and higher durability are desired.

Because of these reasons, a need exists for an image forming apparatus producing high quality images and having high durability.

SUMMARY OF THE INVENTION

Accordingly, the present invention advantageously prevents production of abnormal images due to adherence of foreign particles to a photoreceptor for a long time, and extends lives of a photoreceptor and an image forming apparatus including the photoreceptor.

Briefly these objects and other objects of the present invention as hereinafter will become more readily apparent can be attained by an image forming apparatus which includes a photoreceptor including an electroconductive substrate; a photosensitive layer including a charge generation material and a charge transport material, and overlying the electroconductive substrate; and a protection layer including an inorganic filler in an amount of from 3 to 25% by weight based on total weight of the protection layer and a binder resin, and overlying the photosensitive layer, a charger charging the photoreceptor; an irradiator forming an electrostatic latent image on the photoreceptor; an image developer developing the electrostatic latent image with a developer including a toner to form a toner image on the photoreceptor; a transferer transferring the toner image onto a transfer material; and a cleaner cleaning the photoreceptor, including a rotatable core and a looped brush fiber provided on the surface of the rotatable core so as to contact the photoreceptor, wherein a top of the looped brush fiber is positioned on an upstream side from a root of the looped brush fiber relative to a rotating direction of the rotatable core.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
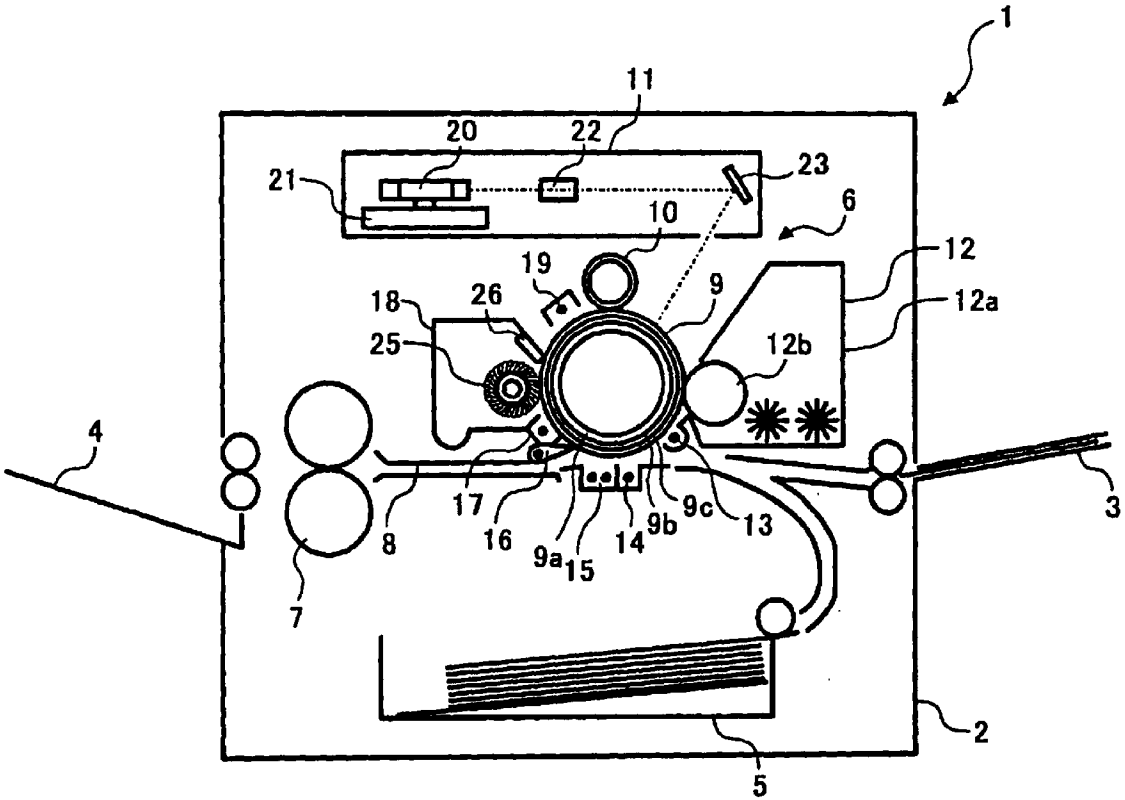
FIG. 1 is a schematic view illustrating a cross section of an embodiment of the printer of the present invention.

Generally, the present invention provides an image forming apparatus which includes a photoreceptor including an electroconductive substrate; a photosensitive layer including a charge generation material and a charge transport material, and overlying the electroconductivesubstrate; and a protection layer including an inorganic filler in an amount of from 3 to 25% by weight based on total weight of the protection layer and a binder resin, and overlying the photosensitive layer, a charger charging the photoreceptor; an irradiator forming an electrostatic latent image on the photoreceptor; an image developer developing the electrostatic latent image with a developer including a toner to form a toner image on the photoreceptor; a transferer transferring the toner image onto a transfer material; and a cleaner cleaning the photoreceptor, including a rotatable core and a looped brush fiber provided on the surface of the rotatable core so as to contact the photoreceptor, wherein a top of the looped brush fiber is positioned on an upstream side from a root of the looped brush 25 fiber relative to a rotating direction of the rotatable core.

A line contact of the looped brush fiber with the photoreceptor removes foreign particles such as toners remaining on a surface of the photoreceptor after charged, irradiated and a toner image is transferred onto a transfer material without damaging a surface thereof even when the brush fiber is thick and firm. In addition, a protection layer on the surface of the photoreceptor, which includes an inorganic filler having a content of from 3 to 25% by weight based on total weight of the protection layer improves printability and properly maintains abrasion resistance of the photoreceptor. Further, a top of the looped brush fiber positioned on an upstream side from a root thereof relative to a rotating direction of the core absorbs a contact force of the top thereof with the surface of the photoreceptor and decreases a running torque of the cleaning brush.

When rotating directions of the cleaning brush and photoreceptor are same at a contact position thereof, opportunities in which a foreign particle having a higher hardness than the protection layer and the photoreceptor are frictionized to each other can be decreased even when such a foreign particle is mixed in the brush fibers. Then, foreign particles removal capability of the cleaning brush does not deteriorate because a line contact of the looped brush fiber with the photoreceptor improves foreign particles removal capability of the cleaning brush more than a point contact of the brush fiber. Further, even when the brush fiber is thick and firm, a contact force of the top thereof with the surface of the photoreceptor and a running torque of the cleaning brush can be reduced when rotating directions of the cleaning brush and photoreceptor are the same at a contact position thereof.

An elastic blade contacting the photoreceptor at a point located on a downstream side from the cleaning brush relative to a rotating direction of the photoreceptor can remove a toner which cannot be removed by the cleaning brush.

The elastic blade having a contact pressure with the photoreceptor of from 10 to 30 g/cm$^2$ can prevent abnormal abrasion of the photoreceptor and remove foreign particles without fail.

The inorganic filler having an average particle diameter of from 0.2 to 0.4 pm can maintain abrasion resistance of the resultant photoreceptor, which can form an electrostatic latent image without impairing formation of fine dots.

The inorganic filler selected from the group consisting of titanium oxide, silica, alumina and their mixtures can impart excellent abrasion resistance to the resultant photoreceptor.

The brush fiber having a thickness of from 4 to 20 denier/filament can maintain its cleanability and surface smoothness of the photoreceptor for a long time.

An embodiment of the present invention will be explained, referring to FIG. 1 or 5. The embodiment is an example applied for a printer as an image forming apparatus.

FIG. 1 is a schematic view illustrating a cross section of an embodiment of the printer of the present invention. A body housing 2 having the shape of a chassis of a printer 1 includes a manual feeding tray 3 in which papers to be manually fed are layered and a paper discharge tray 4 from which papers after images are formed on are discharged.

The body housing 2 includes paper feeding tray 5 in which plural papers are layered and stored. The body housing 2 includes paper route 8 running from the paper feeding tray or manual feeding tray 3 to the paper discharge tray 4 through a printer engine 6 and a fixing unit 7. In this embodiment, papers layered and stored in the manual feeding tray 3 or paper feeding tray 5 are transfer materials.

The printer engine 6 is constituted of a photoreceptor 9 located in the center thereof, a roller 10 uniformly charging a surface of the photoreceptor 9 as a charger, an irradiator irradiating the photoreceptor 9, a developing unit 12 as an image developer, a pre-transfer charger 13, a transfer charger 14 as a transferer, a separation charger 15, a separation pick 16, a pre-cleaning charger 17, a cleaning unit 18, a discharging lamp 19, etc.

The irradiator 11 includes a light source (not shown) emitting light, a polygon mirror 20 scanning the light emitted from the light source, a motor 21 rotating the polygon mirror 20, a mirror 23 reflecting the light scanned by the polygon mirror toward the photoreceptor 9 through a lens 22, etc. An explanation of the irradiator 11 is omitted because of being a known technology.

The photoreceptor 9 will be explained. A detailed illustration of the photoreceptor 9 is omitted because of being a known technology. The photoreceptor 9 is constituted of a cylindrical or a column-shaped electroconductive substrate 9*a* and a photosensitive layer 9*b* formed on a peripheral surface of the electroconductive substrate 9*a*, and rotates clockwise in FIG. 1 and in the direction indicated by an arrow R' in FIG. 5. The photosensitive layer 9*b* may be a single layer or a multilayer, and a protection layer 9C is formed on the surface of the photosensitive layer 9*b*.

Suitable materials for use as the electroconductive substrate 9*a* include electoconductive materials, i.e., metals such as Al, Fe, Cu and Au or metal alloys thereof; materials in which a thin layer of a metal such as Al, Ag and Au or a conductive material such as In2O3and SnO2 is formed on an insulating substrate such as polyester resins, polycarbonate resins, polyimide resins, and glass; and insulators subjected to an electroconductive treatment such as papers subjected to an electroconductive treatment. The shape of the electroconductive substrate 9*a* is not particularly limited, and any electroconductive substrate 9*a* having the shape of a plate, a drum or a belt can be used.

Next, the photosensitive layer 9*b* will be explained. The photosensitive layer 9*b* of the present invention may be a single layer or a multilayer. First, a charge generation layer of the functionally-separated multilayer photosensitive layer 9*b* including the charge generation layer and a charge transport layer will be explained.

The charge generation layer is mainly constituted of a charge generation material, and optionally includes a binder resin. Suitable charge generation materials include inorganic materials and organic materials. Specific examples of the inorganic charge generation materials include crystalline selenium, amorphous selenium, selenium-tellurium alloys, selenium-tellurium-halogen alloys, selenium-arsenic alloys and amorphous silicon. Suitable amorphous silicon includes ones in which a dangling bond is terminated with a hydrogen atom or a halogen atom, or in which a boron atom or a phosphorus atom is doped. Specific examples of the organic charge generation materials include known materials, for example, phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bis-stilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole pigments and the like materials. These charge transport materials can be used alone or in combination.

Specific examples of the binder resin optionally used in the charge generation layer include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These resins can be used alone or in combination. Further, a charge transport material may optionally be included in the charge generation layer.

Suitable methods of forming the charge generation layer include thin film forming methods in a vacuum and casting methods using a solution or a dispersion.

Specific examples of such thin film forming methods in a vacuum include vacuum evaporation methods, glow discharge decomposition methods, ion plating methods, sputtering methods, reaction sputtering methods, CVD methods, etc. A charge generation layer including the above-mentioned inorganic or organic materials can preferably be formed by these methods. The casting methods of forming the charge generation layer include, e.g., preparing a coating liquid by mixing an inorganic or organic charge generation material mentioned above with a solvent such as tetrahydrofuran,cyclohexanone,dioxane, dichloroethane and butanone with a binder resin if necessary, and dispersing the mixture with a ball mill, an attritor, a sand mill, etc. and coating the coating liquid on a substrate, which is diluted if necessary, by a dip coating method, a spray coating method, a bead coating method, etc.

The thus prepared charge generation layer preferably has a thickness of from about 0.01 to 5 $\mu$m, and more preferably from 0.05 to 2 $\mu$m.

Next, a charge transport layer will be explained. The charge transport layer is formed by dissolving a charge transport material and a binder resin with a solvent such as tetrahydrofuran, cyclohexanone, dioxane, dichloroethane and butanone to prepare a coating liquid and coating the liquid on a substrate. The coating methods include dip coating methods, spray coating methods, bead coating methods, etc.

The binder resins for use in the charge transport layer include polycarbonate resins having a good filming property such as bisphenol A type, bisphenol Z type, bisphenol C type polycarbonate resins or their copolymers, polyarylate resins, polysulfone resins, polyester resins, methacrylic resins, polystyrene resins, vinylacetate, epoxy resins and phenoxy resins. These binder resins can be used alone or in combination.

The charge transport materials for use in the charge transport layer include oxazole derivatives, oxadiazole derivatives (described in Japanese Laid-Open Patent Publications Nos. 52-139065 and 52-139066), imidazole derivatives, triphenylamine derivatives (described in Japanese Patent No. 03035622), benzidine derivatives (described in Japanese Patent Publication No. 58-32372), α-phenylstilbene derivatives (described in Japanese Laid-Open Patent Publication No. 57-73075), hydrazone derivatives (described in Japanese Laid-Open Patent Publications Nos. 55-154955, 55-156954, 55-52063 and 56-81850), triphenylmethane derivatives (described in Japanese Laid-Open Patent Publication No. 51-94829), styryl derivatives (described in Japanese Laid-Open Patent Publications Nos. 56-29245 and 58-58552), pyrene derivatives (described in Japanese Patent No. 03081662), etc.

The thus prepared charge transport layer preferably has a thickness of from 5 to 100 μm, and more preferably from 10 to 30 μm.

Next, the single-layered photosensitive layer 9*b* will be explained. When the single-layered photosensitive layer 9*b* is formed by the casting methods, etc., the charge generation materials, charge transport materials and binder resins mentioned above may be used to form a single-layered photosensitive layer. The single-layered photosensitive layer 9*b* can optionally include a plasticizer and a leveling agent. The single-layered photosensitive layer 9*b* preferably has a thickness of 5 to 100 μm, and more preferably from 10 to 30 μm.

In the present invention, the single-layered photosensitive layer 9*b* or the charge transport layer of the multilayer photosensitive layer 9*b* may include a plasticizer and a leveling agent. As the plasticizers, typical plasticizers for resins such as dibutylphthalate and dioctylphthalate can be used. A content of the plasticizers is preferably from about 0 to 30 parts by weight per 100 parts by weight of the binder resin. As the leveling agent, silicone oils such as a dimethyl silicone oil and a methyl phenyl silicone oil, and a polymer or an oligomer having a perfluoroalkyl group in a side chain thereof can be used. A content of the leveling agent is preferably from about 0 to 1 part by weight per 100 parts by weight of the binder resin.

The photosensitive layer of the present invention can include an antioxidant to improve the stability to withstand environmental conditions, namely to avoid decrease of photosensitivity and increase of residual potential. The antioxidant may be included in any layer including an organic material, and preferably included in a layer including a charge transport material.

The antioxidants for use in the photosensitive layer 9*b* in the present invention include mono-phenol compounds such as 2,6-di-t-butyl-p-cresol, butylated hydroxyanisole, 2,6-di-t-butyl-4-ethylphenol and stearyl-β-(3,5-di-t-butyl-4-hydroxyphenyl) propionate; bisphenol compounds such as 2,2'-methylene-bis-(4-methyl-6-t-butylphenol), 2,2'-methylene-bis-(4-ethyl-6-t-butylphenol), 4,4'-thiobis-(3-methyl-6-t-butylphenol) and 4,4'-butylidenebis-(3-methyl-6-t-butylphenol); polymer phenol compounds such as 1,1,3-tris-(2-methyl-4-hydroxy-5-t-butylphenyl)butane, 1,3,5-trimethyl-2,4,6-tris (3,5-di-t-butyl-4-hydroxybenzyl) benzene, tetrakis-[methylene-3-(3',5'-di-t-butyl-4'-25 hydroxyphenyl)propionate]methane, bis [3,3'-bis(4'-hydroxy-3'-t-butylphenyl)butyric acid]glycol ester and tocophenol compounds; paraphenylenediamine compounds such as N-phenyl-N'-isopropyl-p-phenylenediamine, N,N'-di-sec-butyl-p-phenylenediamine, $N^{31}$-phenyl-N-sec-butyl-p-phenylenediamine, N,N'-di-isopropyl-p-phenylenediamine and N,N'-dimethyl-N,N'-di-t-butyl-p-phenylenediamine; hydroquinone compounds such as 2,5-di-t-octylhydroquinone, 2,6-didodecylhydroquinone, 2-dodecylhydroquinone, 2-dodecyl-5-chlorohydroquinone, 2-t-octyl-5-methylhydroquinone and 2-(2-octadecenyl)-5-methylhydroquinone; organic sulfur-containing compounds such as dilauryl-3,3'-thiodipropionate, distearyl-3,3'-thiodipropionate and ditetradecyl-3,3'-thiodipropionate; and organic phosphorus-containing compounds such as triphenylphosphine, tri (nonylphenyl) phosphine, tri (dinonylphenyl) phosphine, tricresylphosphine and tri(2,4-dibutylphenoxy) phosphine.

These compounds are known as antioxidants for rubbers, plastics, and fats and oils, and marketed items thereof can be obtained without difficulty.

In the present invention, a content of the antioxidant is preferably from 0.1 to 100 parts by weight, and more preferably from 2 to 30 parts by weight per 100 parts by weight of the charge transport material.

Next, the protection layer 9*c* for use in the present invention will be explained. The protection layer 9*c* for use in the present invention includes at least an inorganic filler and a binder resin.

Specific examples of the inorganic filler for use in the present invention include titanium oxide, silica, tin oxide, alumina, zirconium oxide, indium oxide, silicon nitride, calcium oxide, zinc oxide, barium sulfate, etc. Surface of these fillers may be treated with an organic material or an inorganic material to improve their dispersibility. As water-repellent treatments, treatments using a silane coupling agent, a fluorine-containing silane coupling agent, or a high fatty acid can be used. Fillers subjected to treatments using an inorganic material include fillers treated with alumina, zirconia, tin oxide or silica. Above all, the titanium oxide, silica and alumina realize good abrasion resistance and electrostatic properties of the resultant photoreceptor. In the present invention, one of the titanium oxide, silica, alumina and a mixture thereof is included in the protection layer 9*c*.

A content of the inorganic filler in the protection layer 9*c* for use in the present invention is preferably from 3 to 25 by weight, and more preferably from 5 to 15% by weight based on total weight of the protection layer 9*c*.

When the content of the inorganic filler is less than 3% by weight based on total weight of the protection layer 9*c*, the resultant photoreceptor does not have sufficient abrasion resistance. When greater than 25% by weight, a foreign particle such as a carrier adhered on the surface of the resultant photoreceptor occasionally gives a deep damage thereto. In addition, when greater than 25%, a charge trap increases and a residual potential after irradiation increases. Therefore, an irradiated part potential increases and a sufficient potential contrast cannot occasionally be obtained.

The inorganic filler in the protection layer 9*c* preferably has an average particle diameter of from 0.2 to 0.4 pm to improve abrasion resistance of the resultant photoreceptor and have the photoreceptor produce high quality images.

When the average particle diameter of the inorganic filler in the protection layer 9*c* is too large, a latent image formed on the photoreceptor 9 tends to be disturbed and the resultant image quality deteriorates. When the average particle diameter of the inorganic filler in the protection layer 9*c* is too small, a connection of the filler with the binder resin therein becomes weak and the filler is easily released therefrom, resulting in deterioration of abrasion resistance of the resultant photoreceptor. In addition, when the average particle diameter of the inorganic filler in the protection layer 9*c* is extremely small, the filler becomes a trap for a charge to transport because quite densely arranged when coated, resulting in deterioration of light attenuation properties and increase of residual potential. Further, when the average particle diameter of the inorganic filler in the protection layer 9*c* is too small, the filler easily agglutinate in a protection layer coating liquid and the resultant protection layer 9*c* does not have a uniform quality. These problems can be solved by the filler having an average particle diameter of from 0.2 to 0.4 μm.

Presence probability of the inorganic filler in the protection layer 9*c* is fixed over the whole protection layer 9*c*. Therefore, the protection layer 9*c* does not impair sensitivity and electrostatic properties of the photosensitive layer 9*b*, nor fineness of the irradiation. The fixed presence probability of the inorganic filler in the protection layer 9*c* can make the protection layer thinner to contribute higher fineness and response of the resultant photoreceptor, and improve abrasion resistance thereof and the resultant image properties. An area occupancy rate of the inorganic filler in the protection layer 9*c* can be controlled by a particle diameter and its distribution of a material used, a formulation of the coating liquid and a coating apparatus.

The binder resins for use in the protection layer 9*c* include acrylic resins, polyester resins, polycarbonate resins having a good filming property such as bisphenol A type, bisphenol Z type, bisphenol C type polycarbonate resins or their copolymers, polyarylate resins, polyamide resins, polyurethane resins, polystyrene resins and epoxy resins resins. In particular, the polycarbonate resins and polyarylate reins are preferably used.

A charge transport material is preferably included in the protection layer 9*c* to impart charge transportability thereto and improve electrostatic properties of the resultant photoreceptor. As the charge transport material, the above-mentioned charge transport materials for use in the charge transport layer can be used.

These compositions for the protection layer 9*c* are dispersed in a solvent such as tetrahydrofuran, cyclohexanone, dioxane, dichloromethane, dichloroethane and butanone to prepare a coating liquid, and the liquid is coated on the photosensitive layer 9*b* by dip coating methods, spray coating methods and bead coating methods.

The photoreceptor 9 of the printer 1 of the present invention can optionally include an intermediate layer which is not shown between the electroconductive substrate 9*a* and the photosensitive layer 9*b*. The intermediate layer for use in the present invention typically includes a resin as a main component. Resins forming the intermediate layer preferably have high solubility in a typical organic solvent in consideration of forming the photosensitive layer 9*b* on the intermediate layer with a solvent. Specific examples of the resins include water-soluble resins such as polyvinylalcohol, casein and sodium polyacrylate; alcohol-soluble resins such as nylon copolymers and methoxymethylated nylon; hardened resins forming a three-dimensional network structure such as polyurethane resins, melamine resins, alkyd resins and epoxy resins. In addition, fine powders of metal oxides such as titanium oxide, silica, alumina, zirconium oxide, tin oxide and indium oxide, metal sulfides or metal nitrides, etc. included in the intermediate layer as a filler can further maintain stable chargeability of the resultant photoreceptor. The intermediate layer can be formed using a proper solvent and coating methods, and preferably has a thickness of from 0.1 to 20 μm, and more preferably from 0.5 to 10 μm.

Next, the developing unit 12 will be explained. The developing unit 12 of the present invention is a two-component developing unit which includes a toner case 12*a* including a developer formed of a toner and a carrier. The toner and carrier for use in the developing unit 12 are not particularly limited, and preferably have a small particle diameter for the purpose of high quality images. Typically, the toner having a small particle diameter means a toner having an average particle diameter of from about 3 to 9 pm, and the carrier having a small particle diameter means a carrier having an average particle diameter of from about 30 to 60 μm. In forming an image, the developing unit 12 feeds the developer in the toner case 12*a* to a surface of the photoreceptor 9 with a developing roller 12*b* to develop an electrostatic latent image formed on the surface of the photoreceptor 9.

The developed image on the photoreceptor 9 by the developing unit 12 is transferred onto a paper by the transfer charger 14. Then, all the toner forming the developed image are not transferred and some toners remain on the photoreceptor 9. In the present invention, the toner remaining on the photoreceptor 9 after transferred is simply called a residual toner.

The cleaning unit 18 includes a cleaning brush 25 and an elastic rubber blade 26 as a blade to remove the residual toner 25 on the surface of the photoreceptor 9.

Figure 2:
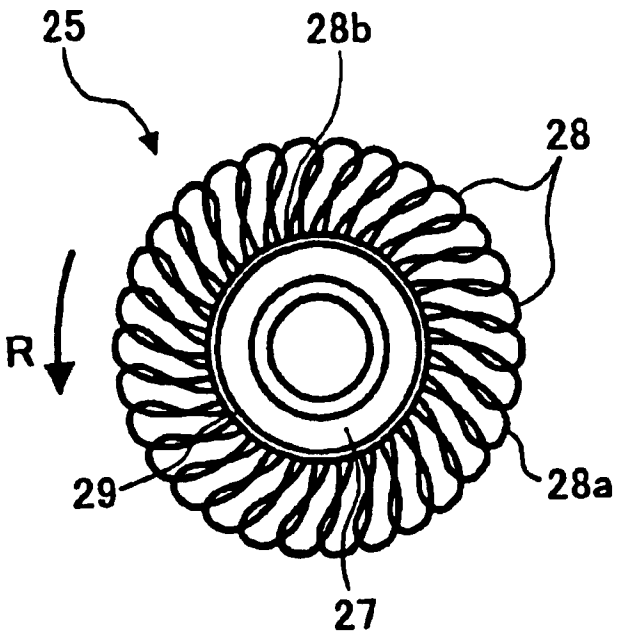
FIG. 2 is a schematic view illustrating a cross section of the cleaning brush of the present invention.
Figure 3:
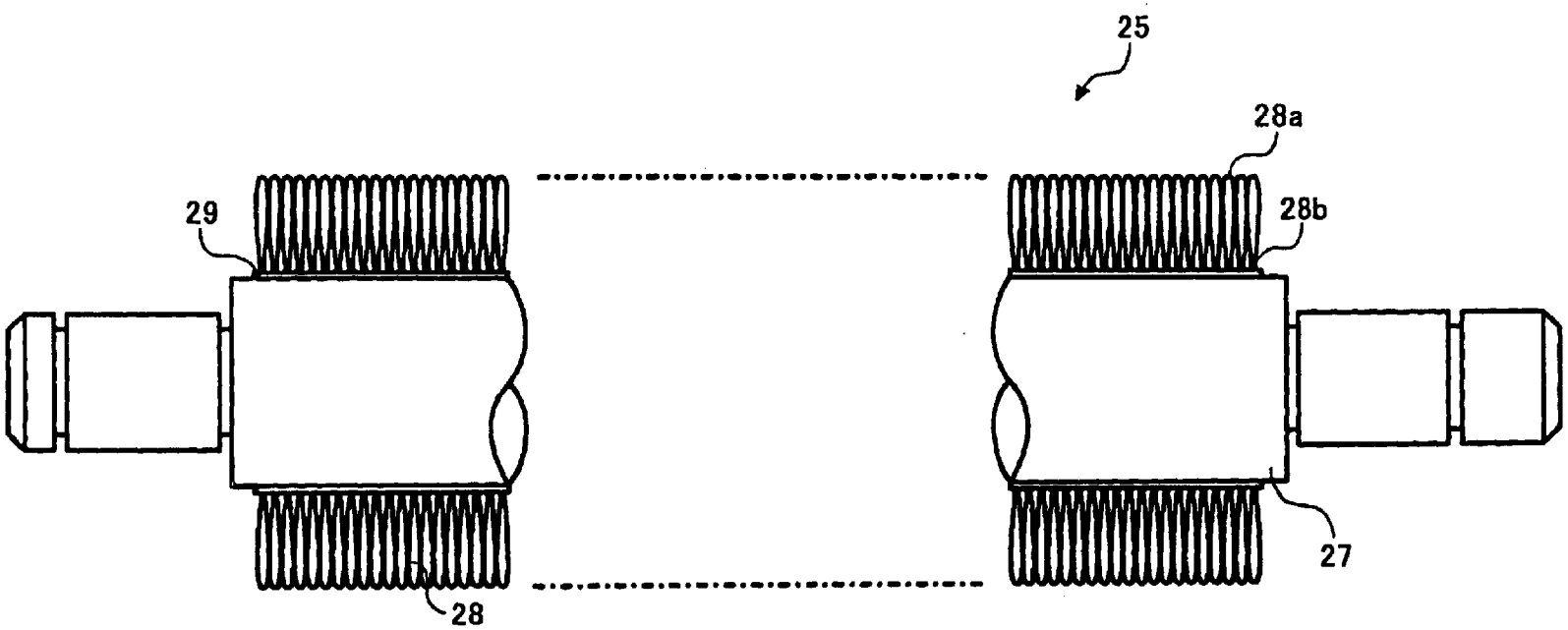
FIG. 3 is a schematic view illustrating longitudinal section of the cleaning brush of the present invention.

FIG. 2 is a schematic view illustrating a cross section of the cleaning brush 25, and FIG. 3 is a schematic view illustrating longitudinal section thereof. An arrow R in FIG. 2 represents a rotating direction. The cleaning brush 25 has a metallic core 27 as an core rotatable in the direction indicated by the arrow R and is supported at a fixed position of the body housing 2. Brush fibers 28 are radially formed all over a peripheral surface of the metallic core 27. The cleaning brush 25 rotates in a same direction of the photoreceptor 9 at a contact position of the cleaning brush 25 with the photoreceptor 9 (refer to FIG. 5). The brush fiber 28 of the cleaning brush 25 has a loop-shaped top 28*a* as magnified in FIG. 4. The loop-shaped top 28*a* is positioned on an upstream side from a root 28*b* of the cleaning brush relative to a rotating direction thereof. The cleaning brush 25 is located such that the loop-shaped top 28*a* contacts the surface of thephotoreceptor 9. The cleaning brush 25 of the present invention includes a loop pile brush formed of a base cloth 29 on which the brush fibers 28 having loop-shaped tops are formed, which is wound around the metallic core 27.

Materials forming the brush fiber 28 are not particularly limited, and various known materials such as nylon resins, polyester resins, rayon resins, polycarbonate resins, methacrylic resins and acrylic resins used in typical electrophotographic printers can be used. These resin for use in the materials for the brush fiber 28 can be used alone or in combination.

In addition, the brush fiber 28 may be subjected to an electroconductive treatment. The electroconductive treatment includes ordinary methods of coating metals on the surface of a fiber, such as plating methods, vacuum deposition methods and sputtering methods; methods of forming an organic layer including a dispersed polymer in which electroconductive fine particles are dispersed on the surface of a fiber; and methods of blending or polycore compound spinning a polymer in which electroconductive fine particles are dispersed. The brush fiber 28 preferably has 50 to 100 loops per 1 $cm^2$ in terms of its cleanability and durability.

Figure 5:
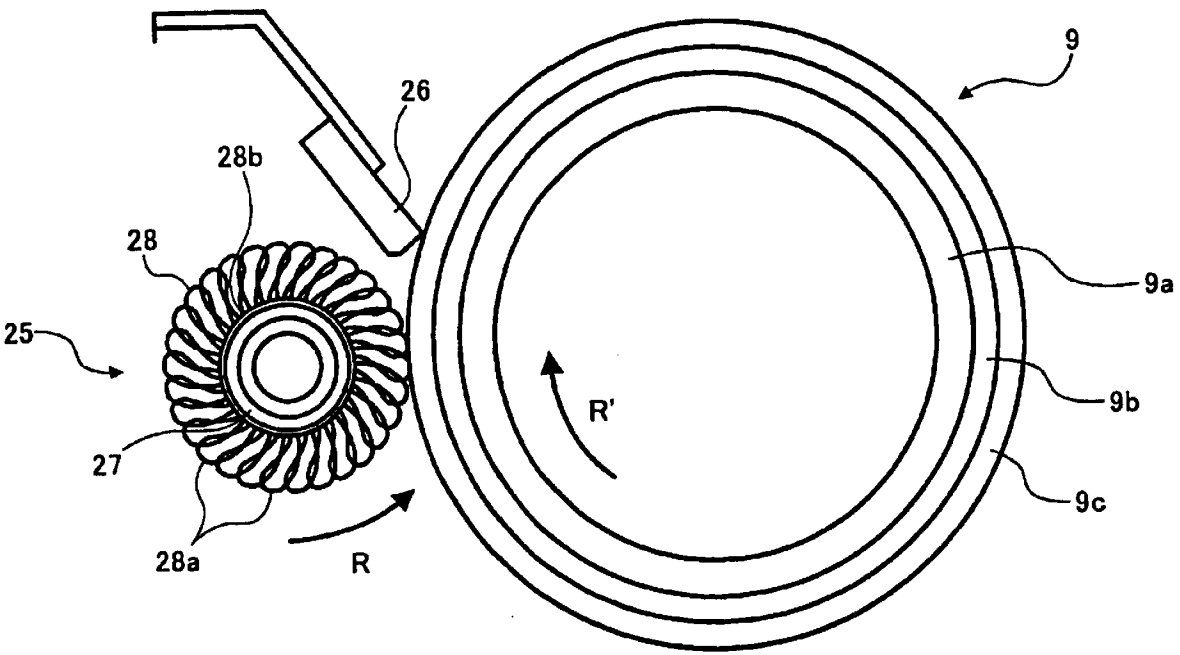
FIG. 5 is a schematic view illustrating a cross section of a photoreceptor, the cleaning brush and elastic rubber blade of the present invention.

The elastic rubber blade 26 is, as FIG. 5 shows, located on a downstream side from the cleaning brush 25 relative to the rotating direction R' of the photoreceptor 9 such that a top 26*a* thereof contacts the photoreceptor 9. Any typically used elastic materials such as silicone rubbers and urethane rubbers capable of closely contacting the photoreceptor 9 without abnormally abrading the photoreceptor 9 can be used for the elastic rubber blade 26. The thickness of the elastic rubber blade 26 is not particularly limited, and preferably from about 1 to 7 mm. A contact pressure of the elastic rubber blade 26 with the photoreceptor 9 is preferably from 10 to 30 g/$cm^2$. In addition, the elastic rubber blade 26 is, as FIG. 5 shows, located on a downstream side from the cleaning brush 25 relative to the rotating direction of the photoreceptor 9 and contacted with the photoreceptor 9. Therefore, the contact direction of the elastic rubber blade 26 with the photoreceptor 9 is a counter direction against the rotating direction thereof.

The surface of the photoreceptor 9 uniformly charged with the charging roller 10 is irradiated by the irradiator 11 driven according to image data to form an electrostatic latent image on the photoreceptor 9 in conformity with the image data. The developing unit 12 feeds a developer stored in the toner case 12*a* with the developing roller to the surface of the photoreceptor 9 to develop the electrostatic latent image formed thereon, and the transfer charger 14 transfers the image developed on the photoreceptor 9 onto a transfer sheet.

First, the cleaning unit 18 removes a residual toner on the photoreceptor 9 with the cleaning brush 25. A line contact of the loop-shaped top 28*a* of the brush fiber 28 included in the cleaning brush 25 with the surface of the photoreceptor 9 removes foreign particles such as residual toners on the surface thereof without damaging the surface thereof even when the brush fiber is thick and firm. In addition, the protection layer 9*c* including an inorganic filler on the outer most surface of the photoreceptor 9 can improve printability and properly maintain abrasion resistance thereof, and therefore occurrence of abnormal images due to adherence of foreign particles to the photoreceptor 9 can be prevented for a long time and the printer 1 including the photoreceptor 9 can have a long life.

The brush fiber 28 may have an optional thickness, and preferably has a thickness of from 1 to 50 denier/filament to remove a residual toner after transferred. When the brush fiber 28 has a thickness that is less than 1 denier/filament, a residual toner after transferred is not sufficiently removed occasionally according to a sort of the toner. When the brush fiber 28 has a thickness that is greater than 50 denier/filament, a surface roughness Rmax (a maximum height of a portion in which a standard length L is removed from a cross-sectional curve) becomes large and defective cleaning occasionally occurs according to the type of toner. Therefore, the brush fiber for use in the present invention more preferably has a thickness of from 4 to 20 denier/filament to maintain its cleanability and surface smoothness of a photoreceptor for a long time.

Because the rotating directions of the cleaning brush 25 and the photoreceptor 9 are the same at a contact position thereof, even when a foreign particle having a higher hardness than the protection layer 9*c* is mixed in the brush fibers 28 , chances that the foreign particle and the photoreceptor 9 are in friction can be decreased and the possibility that the photoreceptor 9 is damaged can be decreased.

Because of a line contact of the loop-shaped top 28*a* of the brush fiber 28 with the surface of the photoreceptor 9, foreign particle removal capability of the cleaning brush 25 can be improved, compared with a contact point of the conventional cleaning brush contacting its cut surface with the photoreceptor. Therefore, even when the rotating directions of the cleaning brush 25 and the photoreceptor 9 are the same at a contact position thereof, the foreign particle removal capability of the cleaning brush 25 does not deteriorate.

Because the rotating directions of the cleaning brush 25 and the photoreceptor 9 are the same at a contact position thereof, even when the brush fiber 28 is thick and firm, a contact force of the top 28*a* of the brush fiber 28 with the surface of the photoreceptor 9 can be absorbed and a running torque of the cleaning brush 25 can be reduced. Therefore, an energy required to drive the cleaning brush 25 can be saved.

Further, the top 28*a* positioned on an upstream side from a root 28*b* of the brush fiber 28 relative to a rotating direction of the cleaning brush 25 can absorb a contact force of the top 28*a* of the brush fiber 28 with the surface of the photoreceptor 9 and reduce the running torque of the cleaning brush 25. Therefore, the energy required to drive the cleaning brush 25 can be saved.

In addition, because the protection layer 9*c* formed on the outer most surface of the photoreceptor 9 includes an inorganic filler having a content of from 3 to 25% by weight based on total weight of the protection layer 9*c*, the photoreceptor 9 can improve its printability and properly maintain its abrasion resistance and have a long life.

Because the inorganic filler included in the protection layer 9*c* has an average particle diameter of from 0.2 to 0.4 um, an electrostatic latent image can be formed on the photoreceptor 9 without impairing formation of a minute dot while the abrasion resistance thereof is maintained. Therefore, the photoreceptor 9 can produce high quality images and have high durability.

Further, the inorganic filler included in the protection layer 9*c*, which is selected from the group consisting of titanium oxide, silica, alumina and their mixtures can impart an excellent abrasion resistance to the photoreceptor 9. Therefore, the printer 1 has high durability.

In addition, in the printer 1 of the present invention, even when the cleaning brush 25 fails to remove a toner, the toner can be removed by the elastic rubber blade 26 because the blade 26 is located on a downstream side from the cleaning brush 25 relative to the rotating direction of the photoreceptor 9. Therefore, a foreign particle on the photoreceptor 9 can be removed without fail and occurrence of abnormal images due to adherence of the foreign particle to the photoreceptor 9 can be prevented.

The elastic rubber blade 26 located on a downstream side from the cleaning brush 25 relative to the rotating direction of the photoreceptor 9 can contact the photoreceptor 9 without ail without a particularly complicated mechanism even while the photoreceptor 9 rotates. Therefore, even when the cleaning brush 25 fails to remove a toner, the toner can be removed by the elastic rubber blade 26 without fail.

In addition, because the elastic rubber blade 26 contacts the photoreceptor 9 at a contact pressure of from 10 to 30 g/$cm^2$, abnormal abrasion of the photoreceptor 9 can be prevented and a foreign particle thereon can be removed without fail. Therefore, occurrence of abnormal images due to adherence of a foreign particle to the photoreceptor 9 can be prevented for a long time and the printer 1 can have a long life.

Figure 6:
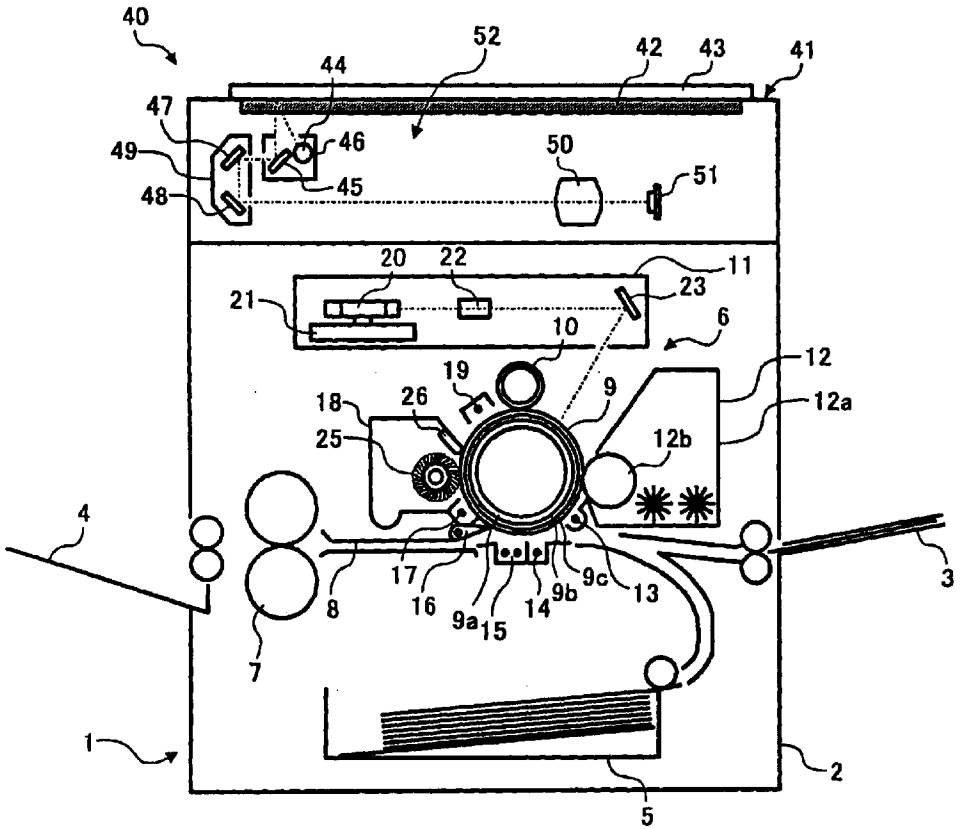
FIG. 6 is a schematic view illustrating a cross section of an embodiment of the copier of the present invention.

Next, another embodiment of the present invention will be explained, referring to FIG. 6. This embodiment is an application to a copier. In FIG. 6, items having the same numerals as those in FIG. 1 are the same items in FIG. 1 and explanations thereof are omitted.

FIG. 6 is a schematic view illustrating a cross section of an embodiment of the copier of the present invention. In FIG. 6, a copier 40 is equipped with a scanner 41 scanning an original image and a printer 1 forming the image on a paper, which is scanned by the scanner 41.

The scanner 41 has a contact glass 42 on which the original (not shown) is set. The original is set on the contact glass 42 facing its image side thereon. Above the contact glass 42, a pressure plate 43 pressing the original onto the contact glass 42 is formed. Below the contact glass 42, a first traveler 46 having a light source 44 emitting light and a mirror 45, a second traveler 49 having two mirrors 47 and 48, and a read optical system 53 constituted of a CCD (charge coupled device) image sensor 51 receiving light led by the mirrors 45, 47 and 48 through an imaging lens 50, etc. are formed. The CCD image sensor 51 works as a photoelectric transferer photoelectrically transferring reflection light from the original imaged on the CCD image sensor 51 to photoelectrically transferred data. The photoelectrically transferred data photoelectrically transferred by the CCD image sensor 51 is processed by an image processor (not shown) to become digital image data. The first and second travelers 46 and 49 are formed so as to be capable of reciprocating along the contact glass 42, and the first traveler 46 travels at a double speed of that of the second traveler 49 by motors or the like (not shown).

The printer 1 drives and controls a printer engine 6 based on the digital image data processed by the image processor (not shown) from the photoelectrically transferred data photoelectrically transferred by the CCDimage sensor 51 to form an image on a recording medium based on the digital image data. The copier 40 can remove foreign particles such as residual toners on the surface of the photoreceptor 9 without damaging the surface thereof, prevent occurrence of abnormal images due to adherence of a foreign particle and stably produce high quality images for a long time.

Figure 7:
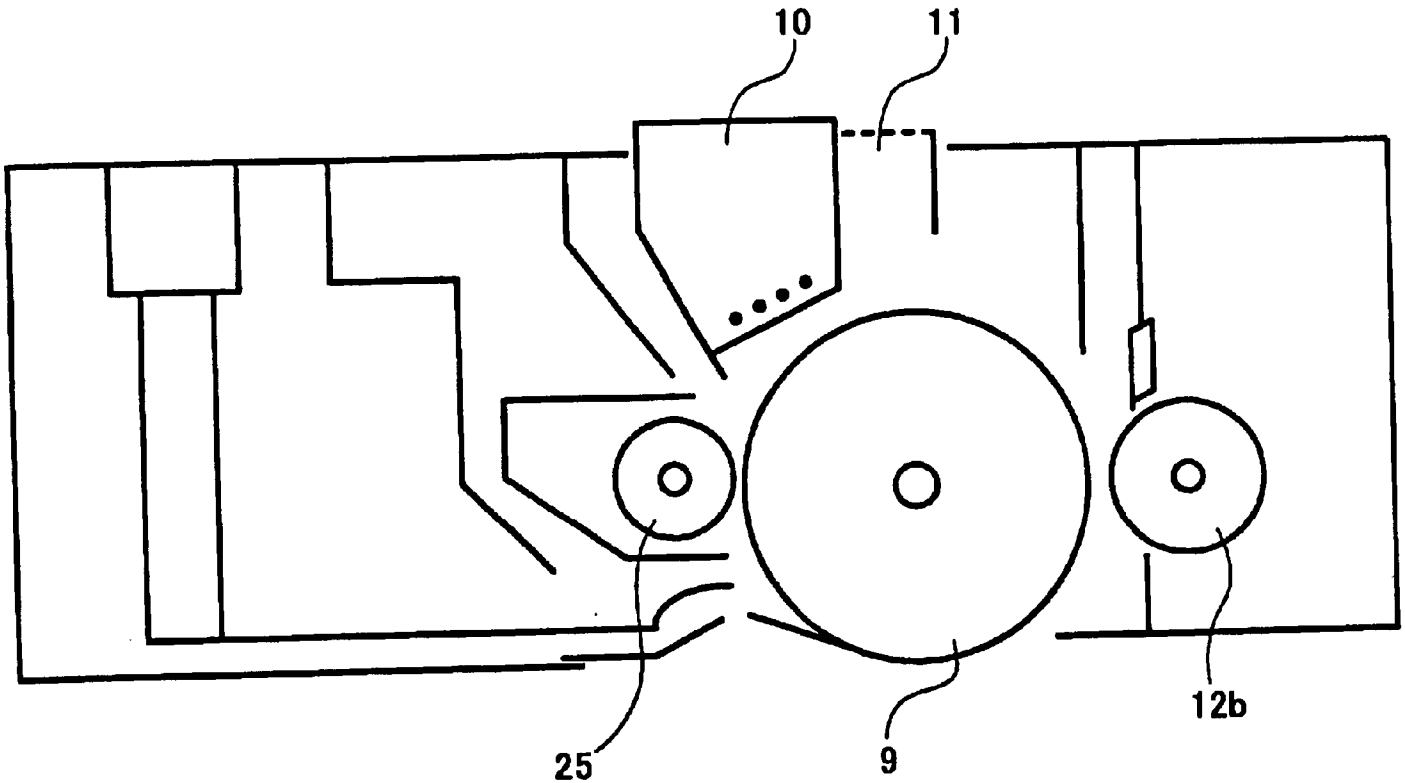
FIG. 7 is a schematic view illustrating a cross section of an embodiment of the process cartridge of the present invention.

The above-mentioned image forming units may be fixedly set in a copier, a facsimile or a printer. However, the image forming units may be set therein as a process cartridge. The process cartridge means an image forming unit (or device) including at least a photoreceptor, and one of a charger, an imagewise light irradiator, an image developer, an image transferer, a cleaner and a discharger. Various process cartridges can be used in the present invention. FIG. 7 illustrates an embodiment of the process cartridge, in which numerals 9 is a photoreceptor, 10 is a charger, 11 is an irradiator, 12*b* is a developing roller and 25 is a cleaning brush.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

A printer in Example 1 includes a photoreceptor prepared by the following method.

After an intermediate layer coating liquid prepared by mixing and pulverizing with a ball mill the following components 10 was coated by a dip coating method on an electroconductive substrate which is an aluminium drum having a diameter of 100 the coated substrate was heated and dried to have an intermediate layer having a thickness of 3.5 $\mu$m.

Intermediate Coating Liquid

| | |
|---|---|
| Alkyd resin (Bekkosol 1307-60-EL from Dainippon Ink & Chemicals, Inc.) | 6 |
| Melamine resin (Super Bekkamin G-821-60 from Dainippon Ink & Chemicals, Inc.) | 4 |
| Titanium oxide (CR-EL from Ishihara Sangyo Kaisha, Ltd.) | 40 |
| Methyl ethyl ketone | 200 |

After a charge generation layer coating liquid prepared by mixing and dispersing with a ball mill the following components was coated on the intermediate layer, the coated substrate was heated and dried to have a charge generation layer having a thickness of 0.2 $\mu$m.

Charge Generation Layer Coating Liquid

| | |
|---|---|
| Y-type oxytitanylphthalocyanine | 8 |
| Polyvinylbutyral | 5 |
| Methyl ethyl ketone | 400 |

After a charge transport layer coating liquid prepared by mixing and dissolving the following components was coated on the charge generation layer, the coated substrate was heated and dried to have a charge transport layer having a thickness of 23 $\mu$m.

Charge Transport Layer Coating Liquid

| | |
|---|---|
| Charge transport material having the following formula (1) | 10 |
| Polycarbonate (Z-polyca from TEIJIN CHEMICALS LTD. having a viscosity-average molecular weight of 50,000) | 10 |
| Tetrahydrofuran | 100 |

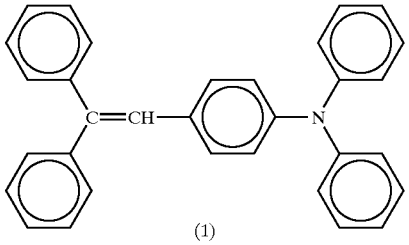

(1)

A protection layer coating liquid prepared by mixing and dispersing with a ball mill the following components was coated on the charge transport layer by a spray coating method to form a protection layer having a thickness of 6.0 μm.

Protection Layer Coating Liquid

| | |
|---|---|
| Polycarbonate (Z-polyca from TEIJIN CHEMICALS LTD. having a viscosity-average molecular weight of 50,000) | 41.9 |
| Alumina (Sumitomo Chemical Co., Ltd.) | 8 |
| Disperser | 0.1 |
| Antioxidant | 0.64 |
| Charge transport material having the formula (1) | 29.3 |
| Cyclohexanone | 355.4 |
| Tetrahydrofuran | 1,320.5 |

The alumina in the protection layer coating liquid has an average particle diameter of 0.30 pm by controlling a dispersing conditions of the protection layer coating liquid. The average particle diameter of the alumina was measured by CAPA-700 from Horiba, Ltd.

Figure 4:
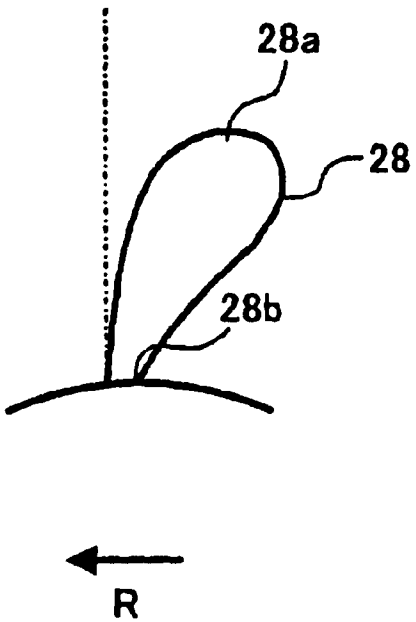
FIG. 4 is an enlarged view of a brush fiber of the cleaning brush of the present invention.

The printer in Example 1, as FIG. 2 shows, includes a cleaning brush formed by winding and adhering a loop pile brush formed of the base cloth and brush fibers having a loop-shaped top inweaved thereon around the metallic core. The loop-shaped top of the brush fiber of the cleaning brush is, as FIGS. 2 and 4 show, positioned on an upstream side from a root of the cleaning brush relative to a rotating direction R thereof. The brush fiber inweaved on the base cloth has a density of 70 pieces/CM2 and thickness of 10 denier/filament.

In addition, the rotating direction of the cleaning brush in the printer in Example 1 is same as that of the photoreceptor at a contact position of the cleaning brush with the photoreceptor. The photoreceptor has a linear speed of 360 mm/sec and the cleaning brush has a linear speed of 400 mm/sec, i.e., 1.11 times as fast as that of the photoreceptor, at a contact position of the cleaning brush with the photoreceptor.

Further, the contact direction of the elastic rubber blade with the photoreceptor in the printer in Example 1 is a counter direction against the rotating direction of the photoreceptor. A contact pressure of the elastic rubber blade with the photoreceptor is 20 g/CM$^2$.

Example 2

The procedures of preparation for the printer in Example 1 were repeated to prepare a printer in Example 2 except for changing the fonnulation of the protection layer coating liquid as follows.

Protection Layer Coating Liquid

| | |
|---|---|
| Polycarbonate (Z-polyca from TEIJIN CHEMICALS LTD. having a viscosity-average molecular weight of 50,000) | 50.6 |
| Alumina (Sumitomo Chemical Co., Ltd.) | 2.7 |
| Disperser | 0.03 |
| Antioxidant | 0.31 |
| Charge transport material having the formula (1) | 35.4 |

-continued

| | |
|---|---|
| Cyclohexanone | 411.9 |
| Tetrahydrofuran | 1,467.2 |

Example 3

The procedures of preparation for the printer in Example 1 were repeated to prepare a printer in Example 3 except for changing the formulation of the protection layer coating liquid as follows.

Protection Layer Coating Liquid

| | |
|---|---|
| Polycarbonate Z-polyca from TEIJIN CHEMICALS LTD. having a viscosity-average molecular weight of 50,000) | 18.4 |
| Alumina (Sumitomo Chemical Co., Ltd.) | 10 |
| Disperser | 0.1 |
| Antioxidant | 0.64 |
| Charge transport material having the formula (1) | 12.9 |
| Cyclohexanone | 166.7 |
| Tetrahydrofuran | 660.2 |

Subsequently, after 500,000 images and 1,000,000 images were produced by the printers prepared in Examples 1 to 3, the following items were evaluated.

Respective solid image densities; local defects such as black spots, white spots, black stripes and white stripes; and abnormal images such as background fouling were evaluated in a comprehensive manner and classified to three stages, i.e., "good", "slightly poor" and "poor".

Irradiated part potential of each photoreceptor when having a charged potential of −800 V was measured.

Abrasion of each photoreceptor was measured after 500,000 images and 1,000,000 images were produced by an eddy current thickness measurer, Fischer Scope MMS from Fischer Instruments K.K.

Surface damages of each photoreceptor were observed by a laser microscope VK-8500 from Keyence Corp. and classified to three stages, i.e., represents no particular damage represents a damage which can be identified by the microscope, but has no influence on the resultant images and X represents a large and deep damage influencing the resultant images.

The evaluation results are shown in the following Table 1.

TABLE 1

| | After 500,000 | | | | After 1,000,000 | | | |
|---|---|---|---|---|---|---|---|---|
| | Image quality | Irradiated part potential (−V) | Abrasion of photoreceptor (μm) | Surface damage of photoreceptor | Image quality | Irradiated part potential (−V) | Abrasion of photoreceptor (μm) | Surface damage of photoreceptor |
| Ex. 1 | Good | 120 | 2.2 | ○ | Good | 150 | 4.1 | ○ |
| Ex. 2 | Good | 100 | 3.1 | ○ | Good | 120 | 4.7 | ○ |
| Ex. 3 | Good | 140 | 1.5 | ○ | Good | 160 | 2.6 | Δ |

Example 4

The procedures of preparation for the printer in Example 1 were repeated to prepare a printer in Example 4 except for reversing rotating direction of the cleaning brush at a contact position with the photoreceptor and changing the linear speed of the cleaning brush to 360 mm/sec, i.e., a relative linear speed was 720 mm/sec.

Example 5

The procedures of preparation for the printer in Example 1 were repeated to prepare a printer in Example 5 except for changing the contact pressure of the elastic rubber blade with the photoreceptor to 10 g/cm$^2$.

Example 6

The procedures of preparation for the printer in Example 1 were repeated to prepare a printer in Example 6 except for changing the contact pressure of the elastic rubber blade with the photoreceptor to 15 g/cm$^2$.

Example 7

The procedures of preparation for the printer in Example 1 were repeated to prepare a printer in Example 7 except for changing the contact pressure of the elastic rubber blade with the photoreceptor to 30 g/cm$^2$.

Example 8

The procedures of preparation for the printer in Example 1 were repeated to prepare a printer in Example 8 except for changing the contact pressure of the elastic rubber blade with the photoreceptor to 40 g/cm$^2$.

Examnple 9

The procedures of preparation for the printer in Example 1 were repeated to prepare a printer in Example 9 except for changing the contact direction of the elastic rubber blade with the photoreceptor to the same direction, i.e., a trail direction, as the rotating direction of the photoreceptor instead of the counter direction.

Example 10

The procedures of preparation for the printer in Example 1 were repeated to prepare a printer in Example 10 except for changing the average particle diameter of the alumina in the protection layer coating liquid to 0.10 pm by controlling the dispersing conditions.

Example 11

The procedures of preparation for the printer in Example 1 were repeated to prepare a printer in Example 11 except for changing the average particle diameter of the alumina in the protection layer coating liquid to 0.20 pm by controlling the dispersing conditions.

Example 12

The procedures of preparation for the printer in Example 1 were repeated to prepare a printer in Example 12 except for changing the average particle diameter of the alumina in the protection layer coating liquid to 0.40 pm by controlling the dispersing conditions.

Example 13

The procedures of preparation for the printer in Example 1 were repeated to prepare a printer in Example 13 except for changing the average particle diameter of the alumina in the protection layer coating liquid to 0.50 pm by controlling the dispersing conditions.

Example 14

The procedures of preparation for the printer in Example 1 were repeated to prepare a printer in Example 14 except for changing the average particle diameter of the alumina in the protection layer coating liquid to 0.70 μm by controlling the dispersing conditions.

Example 15

The procedures of preparation for the printer in Example 1 were repeated to prepare a printer in Example 15 except for changing the alumina to titanium oxide (CR-97 from Ishihara Sangyo Ishihara Sangyo Kaisha, Ltd.) having an average particle 40 diameter of 0.30 pm in the protection layer coating liquid.

Example 16

The procedures of preparation for the printer in Example 1 were repeated to prepare a printer in Example 16 except for changing the alumina to silica (from Nippon Aerosil Co.) having an average particle diameter of 0.30 elm in the protection layer coating liquid.

The printers prepared in Examples 4 to 16 were evaluated in the same method as that of Example 1. The results are shown in Table 2.

TABLE 2

| | After 500,000 | | | | After 1,000,000 | | | |
|---|---|---|---|---|---|---|---|---|
| | Image quality | Irradiated part potential (−V) | Abrasion of photoreceptor (μm) | Surface damage of photoreceptor | Image quality | Irradiated part potential (−V) | Abrasion of photoreceptor (μm) | Surface damage of photoreceptor |
| Ex. 4 | Good | 120 | 2.9 | ○ | Good | 140 | 4.8 | ○ |
| Ex. 5 | Good | 120 | 1.9 | ○ | Good | 150 | 3.5 | ○ |
| Ex. 6 | Good | 120 | 2.3 | ○ | Good | 150 | 4.2 | ○ |
| Ex. 7 | Good | 130 | 2.5 | ○ | Good | 160 | 4.3 | ○ |
| Ex. 8 | Good | 120 | 2.7 | ○ | Good | 140 | 4.5 | ○ |
| Ex. 9 | Good | 120 | 1.9 | ○ | Slightly poor | 140 | 3.3 | ○ |
| Ex. 10 | Good | 120 | 2.7 | ○ | Good | 160 | 4.6 | ○ |
| Ex. 11 | Good | 120 | 2.5 | ○ | Good | 160 | 4.4 | ○ |
| Ex. 12 | Good | 120 | 2.2 | ○ | Good | 140 | 3.5 | ○ |
| Ex. 13 | Good | 130 | 1.8 | ○ | Good | 160 | 3.2 | ○ |
| Ex. 14 | Good | 130 | 1.6 | ○ | Good | 150 | 2.9 | ○ |
| Ex. 15 | Good | 130 | 2.3 | ○ | Good | 160 | 4.2 | ○ |
| Ex. 16 | Good | 150 | 2.5 | ○ | Good | 180 | 4.5 | ○ |

Comparative Example 1

The procedures of preparation for the printer in Example 1 were repeated to prepare a printer in Comparative Example 1 except for excluding the alumina in the protection layer coating liquid.

Comparative Example 2

The procedures of preparation for the printer in Example 1 were repeated to prepare a printer in Comparative Example 2 except for changing the formulation of the protection layer coating liquid as follows.

Protection Layer Coating Liquid

| | |
|---|---|
| Polycarbonate (Z-polyca from TEIJIN CHEMICALS LTD. having a viscosity-average molecular weight of 50,000) | 77.6 |
| Alumina (Sumitomo Chemical Co., Ltd.) | 1.33 |
| Antioxidant | 0.11 |
| Charge transport material having the formula (1) | 54.3 |
| Cyclohexanone | 625.2 |
| Tetrahydrofuran | 2,200.8 |

Comparative Example 3

The procedures of preparation for the printer in Example 1 were repeated to prepare a printer in Comparative Example 3 except for changing the formulation of the protection layer coating liquid as follows.

Protection Layer Coating Liquid

| | |
|---|---|
| Polycarbonate (Z-polyca from TEIJIN CHEMICALS LTD. having a viscosity-average molecular weight of 50,000) | 10.5 |
| Alumina (Sumitomo Chemical Co., Ltd.) | 8 |
| Disperser | 0.1 |
| Antioxidant | 0.64 |
| Charge transport material having the formula (1) | 7.4 |
| Cyclohexanone | 103.8 |
| Tetrahydrofuran | 440.2 |

The printers prepared in Comparative Examples 1 to 3 were evaluated in the same method as that of Example 1. The results are shown in Table 3.

TABLE 3

| | After 500,000 | | | | After 1,000,000 | | | |
|---|---|---|---|---|---|---|---|---|
| | Image quality | Irradiated part potential (−V) | Abrasion of photoreceptor (μm) | Surface damage of photoreceptor | Image quality | Irradiated part potential (−V) | Abrasion of photoreceptor (μm) | Surface damage of photoreceptor |
| Com. Ex. 1 | Poor | Not charged | 14.8 | X | Stopped when 500,000 images were produced | | | |
| Com. Ex. 2 | Slightly poor | 140 | 4.9 | ○ | Poor | 250 | 8.9 | ○ |
| Com. Ex. 3 | Good | 190 | 0.5 | Δ | Poor | 270 | 1.9 | X |

Comparative Example 4

The procedures of preparation for the printer in Example 1 were repeated to prepare a printer in Comparative Example 4 except for excluding the cleaning brush in the cleaner.

Comparative Example 5

The procedures of preparation for the printer in Example 1 were repeated to prepare a printer in Comparative Example 5 except that the loop-shaped top of the cleaning brush is positioned on a downstream side from the root of the cleaning brush relative to a rotating direction thereof.

Comparative Example 6

The procedures of preparation for the printer in Example 1 were repeated to prepare a printer in Comparative Example 6 except that the cleaning brush had leiotrichous brush fibers having uniform length instead of the loop-shaped top.

Comparative Example 7

The procedures of preparation for the printer in Example 1 were repeated to prepare a printer in Comparative Example 7 except that the cleaning brush had leiotrichous brush fibers having nonuniform length instead of the loop-shaped top.

The printers prepared in Comparative Examples 4 to 7 were evaluated in the same method as that of Example 1. The results 15 are shown in Table 4.

TABLE 4

| | After 500,000 | | | | After 1,000,000 | | | |
|---|---|---|---|---|---|---|---|---|
| | Image quality | Irradiated part potential (−V) | Abrasion of photoreceptor (μm) | Surface damage of photoreceptor | Image quality | Irradiated part potential (−V) | Abrasion of photoreceptor (μm) | Surface damage of photoreceptor |
| Com. Ex. 4 | Slightly poor | 190 | 2.1 | ○ | Poor | 250 | 4.5 | ○ |
| Com. Ex. 5 | Slightly poor | 120 | 1.9 | Δ | Poor | 140 | 3.3 | X |
| Com. Ex. 6 | Good | 120 | 2.4 | ○ | Poor | 150 | 3.9 | ○ |
| Com. Ex. 7 | Good | 120 | 2.4 | ○ | Poor | 160 | 4.2 | Δ |

As Tables 1 to 4 show, all of the printers prepared in Examples 1 to 16 satisfying the requirements of the present invention could produce high quality images and have high durability. However, the printers prepared in Comparative Examples 1 to 7 which were not satisfying the requirements of the present invention produced poor quality images and did not have sufficient durability.

This document claims priority and contains subject matter related to Japanese Patent Application No. 2002-219695 filed on Jul. 29, 2002, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising: a photoreceptor comprising:

an electroconductive substrate, a photosensitive layer comprising a charge generation material and a charge transport material, and overlying the electroconductive substrate, and a protection layer comprising an inorganic filler in an amount of from 3 to 25% by weight based on total weight of the protection layer and a binder resin, and overlying the photosensitive layer;

a charger configured to charge the photoreceptor;

an irradiator configured to form an electrostatic latent image on the photoreceptor;

an image developer configured to develop the electrostatic latent image with a developer comprising a toner to form a toner image on the photoreceptor;

a transferer configured to transfer the toner image onto a transfer material; and a cleaner configured to clean the photoreceptor, comprising a rotatable core and a looped brush fiber provided on the surface of the rotatable core so as to contact the photoreceptor, wherein a top of the looped brush fiber is positioned on an upstream side from a root of the looped brush fiber relative to a rotating direction of the rotatable core.

2. The image forming apparatus of claim 1, wherein the cleaner has a same rotating direction as that of the photoreceptor at a contact position of the cleaner with the photoreceptor.

3. The image forming apparatus of claim 1, further comprising an elastic blade contacting the photoreceptor at a point located on a downstream side from the cleaner relative to the rotating direction of the photoreceptor.

4. The image forming apparatus of claim 3, wherein the elastic blade contacts the photoreceptor at a pressure of from 10 to 30 g/cm$^2$.

5. The image forming apparatus of claim 1, wherein the inorganic filler has an average particle diameter of from 0.2 to 0.4 pm.

6. The image forming apparatus of claim 1, wherein the inorganic filler is a member selected from the group consisting of titanium oxide, silica, alumina and their mixtures.

7. The image forming apparatus of claim 1, wherein the looped brush fiber comprises a filament having a thickness of from 4 to 20 denier.

8. A copier comprising:

an image reader configured to read an original image and produce image data thereof; and the image forming apparatus according to claim 1, wherein the irradiator forms the electrostatic latent image according to the image data.

9. A process cartridge comprising: a photoreceptor comprising:

an electroconductive substrate, a photosensitive layer comprising a charge generation material and a charge transport material, and overlying the electroconductive substrate, and a protection layer comprising an inorganic filler in an amount of from 3 to 25% by weight based on total weight of the protection layer and a binder resin, and overlying the photosensitive layer, and at least one of:

a charger configured to charge the photoreceptor; an image developer configured to develop the electrostatic latent image with a developer comprising a toner to form a toner image on the photoreceptor; and a cleaner configured to clean the photoreceptor, comprising a rotatable core and a looped brush fiber provided on the surface of the rotatable core so as to contact the photoreceptor, wherein a top of the looped brush fiber is positioned on an upstream side from a root of the looped brush fiber relative to a rotating direction of the rotatable core.

* * * * *